US010006323B2

(12) United States Patent
Gallon

(10) Patent No.: US 10,006,323 B2
(45) Date of Patent: Jun. 26, 2018

(54) MULTI-STEP SLIDING CAM ACTUATORS FOR INTERNAL COMBUSTION ENGINE ASSEMBLY

(71) Applicant: GM GLOBAL TECHNOLOGY OPERATIONS LLC, Detroit, MI (US)

(72) Inventor: Robert J. Gallon, Northville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 105 days.

(21) Appl. No.: 15/291,101

(22) Filed: Oct. 12, 2016

(65) Prior Publication Data

US 2018/0100414 A1 Apr. 12, 2018

(51) Int. Cl.

| | |
|---|---|
| ***F01L 1/46*** | (2006.01) |
| ***F01L 13/00*** | (2006.01) |
| ***F01L 1/047*** | (2006.01) |
| ***F02D 13/02*** | (2006.01) |

(52) U.S. Cl.

CPC ..... *F01L 13/0036* (2013.01); *F01L 1/047* (2013.01); *F02D 13/0203* (2013.01); *F01L 1/46* (2013.01); *F01L 2001/0473* (2013.01); *F01L 2013/0052* (2013.01)

(58) Field of Classification Search

CPC ..... F01L 2001/0473; F01L 1/46; F01L 2013/0052; F01L 2800/16

USPC ..... 123/90.18

See application file for complete search history.

(56) References Cited

U.S. PATENT DOCUMENTS

| | | | | |
|---|---|---|---|---|
| 8,662,033 | B2 | 3/2014 | Gallon et al. | |
| 8,667,953 | B2 | 3/2014 | Gallon et al. | |
| 8,820,277 | B2 | 9/2014 | Moon et al. | |
| 8,965,667 | B2 | 2/2015 | Sczomak et al. | |
| 2014/0190432 | A1* | 7/2014 | McConville | F01L 1/22 123/90.17 |
| 2015/0101552 | A1* | 4/2015 | Choi | F01L 13/0036 123/90.15 |
| 2016/0125990 | A1* | 5/2016 | Strigerwald | F01L 13/0036 335/229 |

FOREIGN PATENT DOCUMENTS

| | | | | |
|---|---|---|---|---|
| JP | 2014134165 | A * | 7/2014 | F01L 1/047 |

* cited by examiner

*Primary Examiner* — Jorge Leon, Jr.
(74) *Attorney, Agent, or Firm* — Quinn IP Law

(57) ABSTRACT

Disclosed are sliding cam actuators, methods for making and using such actuators, and motor vehicles with internal combustion engines employing sliding cam actuators. A sliding cam actuator is disclosed with two actuator pins projecting from an actuator housing. These pins move from retracted to extended positions and engage a shift barrel on a sliding camshaft. An actuator assembly moves each actuator pin to its extended position into engagement with the shift barrel to thereby slide the camshaft to a different location. An actuator shank is attached to the actuator housing and engaged with the actuator pins. Moving the first actuator pin to its extended position moves the actuator shank in one direction, which moves the second actuator pin towards its retracted position. Moving the second actuator pin to its extended position causes the actuator shank to move in another direction, which moves the first actuator pin towards its retracted position.

20 Claims, 3 Drawing Sheets

MULTI-STEP SLIDING CAM ACTUATORS FOR INTERNAL COMBUSTION ENGINE ASSEMBLY

INTRODUCTION

The present disclosure relates generally to internal combustion engine (ICE) assemblies. More specifically, aspects of this disclosure relate to valve trains with multi-step sliding cam systems for reciprocating-piston type internal combustion engines.

Current production motor vehicles, such as the modern-day automobile, are originally equipped with a powertrain that operates to propel the vehicle and power the onboard vehicle electronics. The powertrain, which is inclusive of, and oftentimes misclassified as, a drivetrain, is generally comprised of a prime mover, such as an engine, that delivers driving power to the vehicle's final drive system (e.g., rear differential, axle, and wheels) through a multi-speed power transmission. Automobiles have normally been powered by a reciprocating-piston type internal combustion engine (ICE) because of its ready availability and relatively inexpensive cost, light weight, and overall efficiency. Such engines include two and four-stroke compression-ignited diesel engines, four-stroke spark-ignited gasoline engines, six-stroke architectures, and rotary engines, as some examples. Hybrid vehicles, on the other hand, utilize alternative power sources, such as electric motor-generators, to propel the vehicle, minimizing reliance on the engine for power and increasing overall fuel economy.

A typical overhead valve internal combustion engine includes an engine block with cylinder bores each having a piston reciprocally movable therein. Coupled to a top surface of the engine block is a cylinder head that cooperates with the piston and cylinder bore to form a variable-volume combustion chamber. These reciprocating pistons are used to convert pressure, generated by igniting a fuel-and-air mixture in the combustion chamber, into rotational forces to drive a crankshaft. The cylinder head defines intake ports through which air, provided by an intake manifold, is selectively introduced to each combustion chamber. Also defined in the cylinder head are exhaust ports through which exhaust gases and byproducts of combustion are selectively evacuated from a combustion chamber to an exhaust manifold. The exhaust manifold, in turn, collects and combines the exhaust gases for recirculation into the intake manifold, delivery to a turbine-driven turbocharger, or evacuation from the ICE via an exhaust system.

A cylinder head (or heads, if the engine has multiple banks of cylinders) may house the ICE's valve train—inlet valves, exhaust valves, rocker arms, pushrods, and, in some instances, a camshaft. The valve train is part of the powertrain subsystem responsible for controlling the amount of fuel-entrained air and exhaust gas entering and exiting the engine's combustion chambers at any given point in time. Engine torque and power output is varied by modulating valve lift and timing, which is accomplished by driving the inlet and exhaust valves, either directly or indirectly, by cam lobes on the rotating camshaft. Different engine speeds typically require different valve timing and lift for optimum performance. Generally, low engine speeds require valves to open a relatively small amount over a shorter duration, while high engine speeds require valves to open a relatively larger amount over a longer duration for optimum performance. By adding the ability to choose between different cam profiles to drive the valves differently at different speeds and loads, engines are able to better optimize performance throughout a wider range of engine operating conditions.

SUMMARY

Disclosed herein are sliding cam actuators for internal combustion engine assemblies, methods for making and methods for using such sliding cam actuators, reciprocating-piston type internal combustion engines having a valve train with a multi-step sliding cam system using a sliding cam actuator, and motor vehicle using such engines. By way of example, and not limitation, there is presented a novel two-pin electronic cam actuator for a three-step sliding cam system (SCS). This sliding cam actuator includes a pair of electronically activated short-throw linear actuators packaged inside an actuator housing. Each linear actuator includes a coil-driven piston that abuts a proximal end of a spring-biased sliding actuator pin. A distal end of each actuator pin projects out of the housing to selectively engage a shift barrel mounted onto an axially displaceable rotating camshaft. Upon activation of a linear actuator, the piston translates rectilinearly towards its respective actuator pin and presses the pin into engagement with the shift barrel. This, in turn, will translate the camshaft, e.g., in a fore or aft direction, and thereby change which of an assortment of different cam lobes will engage the valves of the engine's valve train.

The spring-biased sliding actuator pins are columnar, formed or machined with a toroidal slot adjacent the proximal end of the pin. Each toroidal slot extends along the length of the actuator pin, with the slot of one pin being axially longer than the slot of the other pin. An actuator "seesaw" shank is pivotably coupled to the actuator housing, interposed between the two sliding actuator pins. One end of the actuator shank is seated inside the toroidal slot in the first actuator pin, whereas the opposing second end of the shank is seated inside the slot in the second actuator pin. When the first linear actuator is fired, and the corresponding first actuator pin translates towards the shift barrel, the pin will rotate the actuator shank like a seesaw in a first (e.g., counterclockwise) direction. The shank, in turn, will push the second actuator pin away from the shift barrel. Conversely, firing the second linear actuator will move the second actuator pin towards the shift barrel; the actuator shank will responsively rotate in a second (e.g., clockwise) direction and push the first actuator pin away from the shift barrel.

Attendant benefits for at least some of the disclosed concepts include sliding cam actuator architectures that preclude both actuator pins from firing concurrently, and thereby prevent overhanging pin failures. An "overhanging pin" failure may be typified as an actuator state resulting from both actuator pins being inadvertently activated at the same time such that the camshaft is trapped between phases and neither pin of the actuator properly seats in the engagement groove cut in the shift barrel of the camshaft. Prior art sliding cam system designs using a two-pin actuator require a failure mode that may disable the vehicle and/or set a malfunction indicator light (MIL) requiring service work. Some methods to detect an overhanging pin failure require additional cam position sensors along with software and electronic hardware to rectify the fault. Disclosed systems help to reduce manufacturing costs, proof of concept time, and warranty claims by disposing of superfluous failure detection software and hardware, and eliminating the need for a vehicle failure mode with attendant servicing.

Aspects of the present disclosure are directed to multi-step sliding cam actuators for internal combustion engine assemblies with sliding cam systems. Disclosed, for example, is a sliding cam actuator for an internal combustion engine assembly, which employs various engine valves operatively engaged with a sliding camshaft bearing a shift barrel and multiple cams. The sliding cam actuator includes at least two actuator pins that project from an actuator housing. Each actuator pin selectively moves from a respective retracted position to a respective extended position, whereat the pin engages the shift barrel of the sliding camshaft. A pin actuator assembly is attached to the actuator housing and operable in at least two activated states. When in a first activated state, the pin actuator moves the first actuator pin to the first extended position and into engagement with the shift barrel to thereby slide the camshaft to a first cam location. Conversely, when the pin actuator is in the second activated state, it moves the second actuator pin to the second extended position and into engagement with the shift barrel to thereby slide the camshaft to a second cam location. An actuator shank is movably attached to the actuator housing and engaged with the actuator pins. Moving the first actuator pin to its extended position causes the actuator shank to move in a first direction such that the actuator shank moves the second actuator pin towards the second retracted position. On the other hand, moving the second actuator pin to its extended position causes the actuator shank to move in a second direction such that the actuator shank moves the first actuator pin towards the first retracted position.

Other aspects of the present disclosure are directed to motor vehicles with reciprocating-piston-type overhead cam engine assemblies with multi-step sliding cam systems for variable valve lift (VVL) operation. A "motor vehicle," as used herein, may include any relevant vehicle platform, such as passenger vehicles (internal combustion engine (ICE), hybrid, fully or partially autonomous, etc.), commercial vehicles, industrial vehicles, tracked vehicles, off-road and all-terrain vehicles (ATV), farm equipment, boats, airplanes, etc. In an example, a motor vehicle is presented that includes a vehicle body with an engine compartment, and an internal combustion engine assembly mounted inside the engine compartment. The ICE assembly includes an engine block with one or more cylinder banks defining cylinder bores. A piston is reciprocally movable within each one of the cylinder bores. Assorted engine valves are operable to regulate fluid intake and exhaust for the cylinder bores. An axially displaceable camshaft, which is rotatably mounted adjacent the engine valves, carries a shift barrel and multiple cam lobes with distinctly shaped profiles for operating the engine valves at distinct lifts.

The vehicle ICE assembly also includes a multi-step sliding cam actuator for controlling axial displacement of the sliding camshaft. This sliding cam actuator includes two (and only two) slidable actuator pins that selectively translate from respective retracted positions to respective extended positions, whereat the pins engage the shift barrel to thereby axially displace the camshaft. A pin actuator assembly is operable in numerous states: a neutral state; a first activated state, whereat the pin actuator assembly pushes the first actuator pin to the first extended position and into engagement with the shift barrel to thereby slide the camshaft to a first cam location; and, a second activated state, whereat the pin actuator pushes the second actuator pin to the second extended position and into engagement with the shift barrel to thereby slide the camshaft to a second cam location, distinct from the first cam location. An actuator shank is interposed between and engaged with the two actuator pins. Sliding the first actuator pin to its extended position causes the actuator shank to rotate in a first direction and push the second actuator pin to its retracted position. Conversely, sliding the second actuator pin to its extended position causes the actuator shank to rotate in a second direction, opposite the first direction, and push the first actuator pin to its retracted position. With this configuration, the actuators pins are prevented from being simultaneously extended.

Additional aspects of this disclosure are directed to methods of making and methods of using multi-step sliding cam actuators for internal combustion engine assemblies with sliding cam systems. For instance, a method is disclosed for assembling a sliding cam actuator for an ICE assembly with multiple engine valves operatively engaged with a sliding camshaft. The method includes, in any order and in any combination: attaching first and second actuator pins to an actuator housing such that the actuator pins are selectively movable from respective retracted to respective extended positions, whereat the pins engage with a shift barrel on the sliding camshaft; attaching a pin actuator assembly to the actuator housing, the pin actuator assembly being operable in a first activated state, whereat the pin actuator assembly moves the first actuator pin to the first extended position and into engagement with the shift barrel to thereby slide the camshaft to a first cam location, and a second activated state, whereat the pin actuator moves assembly the second actuator pin to a second extended position and into engagement with the shift barrel to thereby slide the camshaft to a second cam location; and, movably attaching an actuator shank to the actuator housing such that the actuator shank engages the actuator pins. With this configuration, moving the first actuator pin to the first extended position causes the actuator shank to move in a first direction; in so doing, the actuator shank moves the second actuator pin towards the second retracted position away from the shift barrel. In addition, moving the second actuator pin to the second extended position causes the actuator shank to move in a second direction; in so doing, the actuator shank moves the first actuator pin towards the first retracted position away from the shift barrel.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of representative embodiments and representative modes for carrying out the present disclosure when taken in connection with the accompanying drawings and the appended claims. Moreover, this disclosure expressly includes any and all combinations and subcombinations of the elements and features presented above and below.

Figure 1:
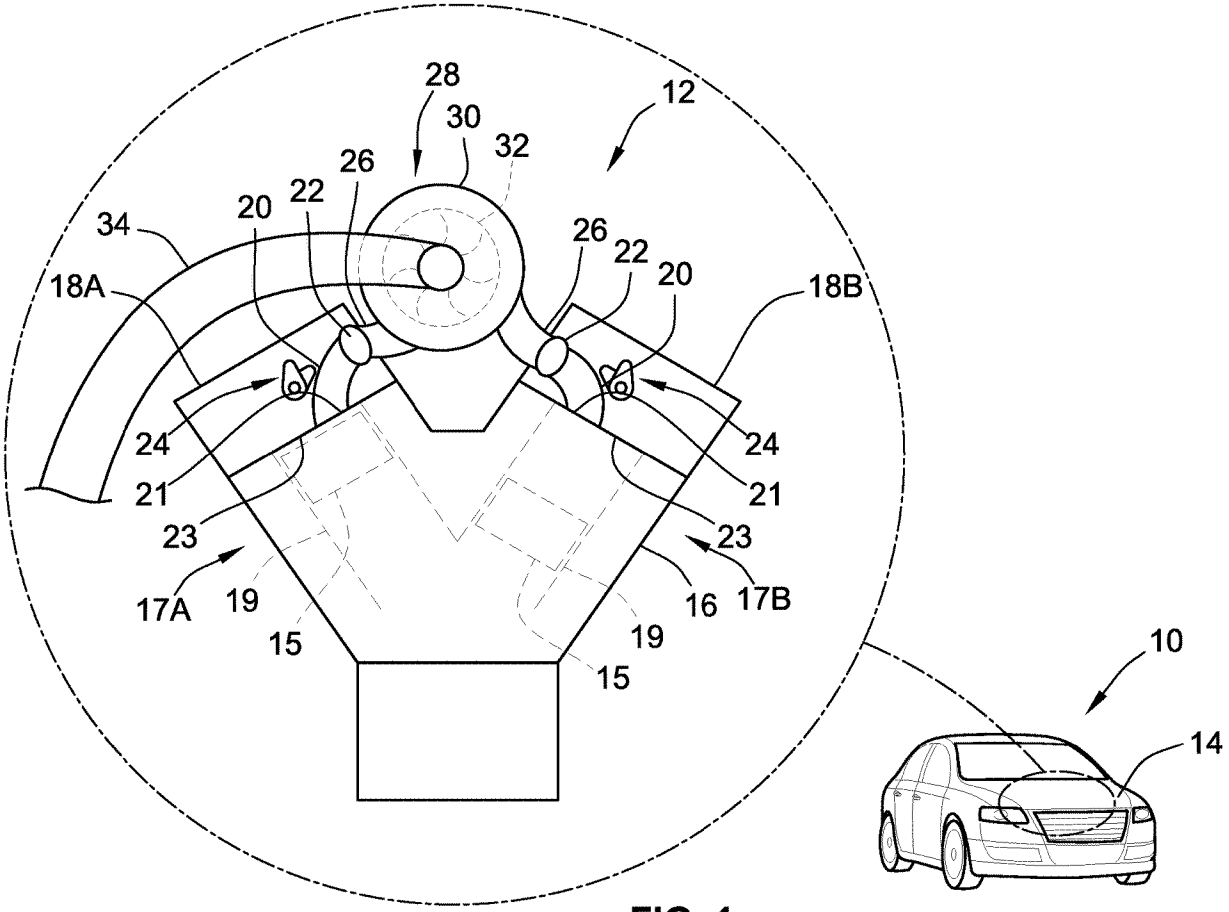
FIG. 1 is a front perspective-view illustration of a representative motor vehicle with an inset schematic illustration of a representative V-type overhead cam internal combustion engine (ICE) assembly in accordance with aspects of the present disclosure.

The present disclosure is susceptible to various modifications and alternative forms, and some representative embodiments have been shown by way of example in the drawings and will be described in detail herein. It should be understood, however, that the novel aspects of this disclosure are not limited to the particular forms illustrated in the appended drawings. Rather, the disclosure is to cover all modifications, equivalents, combinations, subcombinations, and alternatives falling within the scope and spirit of the disclosure as defined by the appended claims.

DETAILED DESCRIPTION OF THE ILLUSTRATED EMBODIMENTS

This disclosure is susceptible of embodiment in many different forms. There are shown in the drawings and will herein be described in detail representative embodiments of the disclosure with the understanding that the present disclosure is to be considered as an exemplification of the principles of the disclosure and is not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the words "including" and "comprising" and "having" mean "including without limitation." Moreover, words of approximation, such as "about," "almost," "substantially," "approximately," and the like, may be used herein in the sense of "at, near, or nearly at," or "within 3-5% of," or "within acceptable manufacturing tolerances," or any logical combination thereof, for example.

Referring now to the drawings, wherein like reference numbers refer to like features throughout the several views, there is shown in FIG. 1 a perspective-view illustration of a representative automobile, which is designated generally at 10 and portrayed herein for purposes of discussion as a four-door sedan-style passenger vehicle. Mounted at a forward portion of the automobile 10, e.g., aft of a front bumper fascia and grille and forward of a passenger compartment, is an internal combustion engine (ICE) assembly 12 housed within an engine compartment covered by an engine hood 14. The illustrated automobile 10—also referred to herein as "motor vehicle" or "vehicle" for short—is merely an exemplary application with which the novel aspects and features of this disclosure may be practiced. In the same vein, the implementation of the present concepts into a 6-cylinder V-type engine configuration should also be appreciated as an exemplary application of the novel concepts disclosed herein. As such, it will be understood that the aspects and features of the present disclosure may be applied to other engine assemblies and utilized for any logically relevant type of motor vehicle. Lastly, the drawings presented herein are not necessarily to scale and are provided purely for instructional purposes. Thus, the specific and relative dimensions shown in the drawings are not to be construed as limiting.

There is shown in FIG. 1 a representative single overhead cam (SOHC), V-type 6-cylinder (V6) reciprocating-piston ICE assembly 12. The ICE assembly 12 operates to propel the vehicle 10, for example, as a compression-ignited (CI) diesel engine or spark-ignited (SI) gasoline engine, including flexible-fuel vehicle (FFV) and hybrid vehicle variations thereof. The ICE assembly 12 has an engine block 16 (often used synonymously with "cylinder case") with first and second banks 17A and 17B, respectively, of cylinder bores 19. As shown, the banks of cylinder bores (or "cylinder banks" for short) 17A, 17B are disposed at an included angle of less than 180 degrees (e.g., a 60 or 90 degree angle) relative to each other. Each cylinder bank 17A, 17B defines therein one or more cylinder bores, shown in phantom at 19 in FIG. 1; a conventional V6 configuration is composed of three bores per cylinder bank. A piston 15 is reciprocally movable within each of the cylinder bores 19. While the illustrated engine configuration is shown with a single camshaft 24 per cylinder bank 17A, 17B, other overhead camshaft (OHC) and non-OHC architectures (e.g., flathead engines) are deemed to be within the scope of this disclosure. Only select components of the ICE assembly 12 have been shown by way of example in the drawings and will be described in detail herein. However, it should be understood that the ICE assembly 12 may include other known and hereafter developed engine features within the scope of this disclosure.

First and second cylinder heads 18A and 18B are respectively mounted to the first and second cylinder banks 17A, 17B, e.g., via threaded fasteners (not shown). Chamber surfaces 23, integrally formed along the bottom of each cylinder head 18A, 18B, are positioned to each align with one of the cylinder bores 19, as well as the piston 15 disposed therein, to cooperatively define a variable-volume combustion chamber. This pair of cylinder heads 18A, 18B may define a corresponding number of exhaust ports 21 (e.g., one or two ports per combustion chamber) through which exhaust gases and byproducts of combustion are selectively evacuated from the cylinder bores 19. Each exhaust port 21 communicates exhaust gases—such as through a dedicated exhaust runner 20—to a respective runner exit port 22. For at least some embodiments, the cylinder heads may take on an integrated exhaust manifold (IEM) cylinder head configuration where the runner 20 and exit port 22 features are formed integrally with the respective cylinder heads 18A, 18B, thereby obviating the need for fasteners and gaskets typically required for exhaust manifold attachment. In so doing, the exhaust runners 20 are extensions of the exhaust ports 21 for connecting each exhaust port 21 to an exit port 22 in the cylinder head 18A, 18B to evacuate exhaust gas from the engine 12. A respective discharge pipe 26 is in fluid communication with each integral exhaust manifold, namely the runner exit port 22. Potential exhaust gas leak paths during operation of the ICE assembly 12 are reduced by integrally forming these features with the cylinder heads 18A, 18B.

In the example illustrated in FIG. 1, a turbine-driven forced-induction turbocharger 28 is fluidly coupled to the ICE assembly 12. Turbocharger 28 includes a turbine housing 30 into which the discharge pipes 26 communicate exhaust gases from the cylinder heads 18A, 18B. Optional engine configurations may eliminate the discharge pipes 26 by incorporating exhaust discharge conduits into the turbine housing 30. Heat and kinetic energy of the exhaust gases cause a turbine blade, shown in phantom at 32 in FIG. 1, to spin or rotate within the turbine housing 30. When some or all of the useful energy is removed by the turbocharger 28, the exhaust gases are communicated to a turbine discharge pipe 34 for eventual release to the atmosphere. The inboard configuration of the cylinder heads 18A, 18B permit the length of the discharge pipes 26 to be minimized. By minimizing the length of the discharge pipes 26, more heat energy of the exhaust gas—that would otherwise be lost to the atmosphere through heat transfer—may be retained to rotate the turbine blade 32. While the ICE assembly 12 shown in FIG. 1 includes the turbocharger 28, those skilled in the art will recognize that the turbocharger 28 may be eliminated or modified while remaining within the scope of this disclosure.

Figure 2:
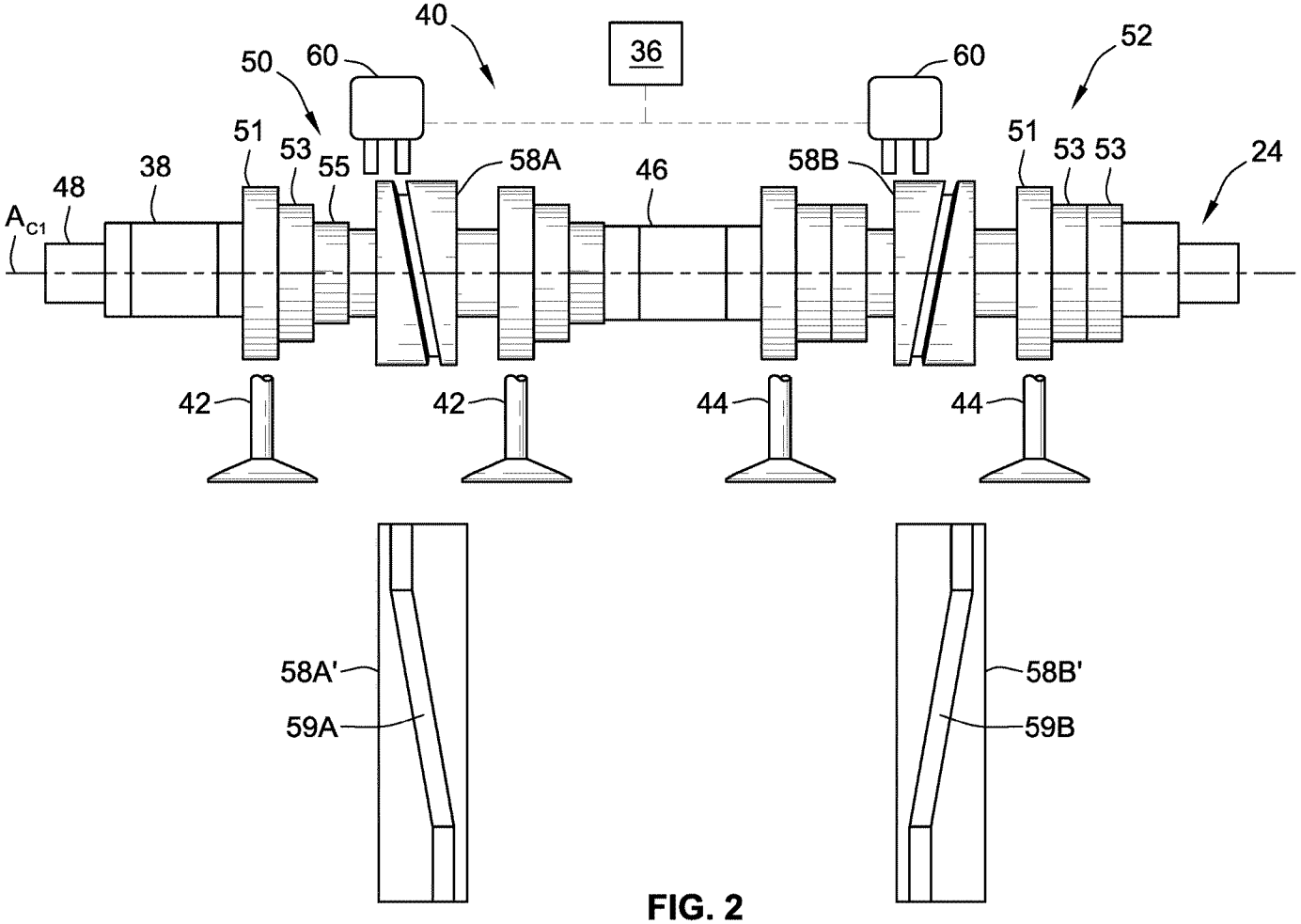
FIG. 2 is a side-view illustration of a representative multi-step sliding cam system (SCS) for an internal combustion engine, such as the ICE assembly of FIG. 1 in accordance with aspects of the present disclosure.

There is shown in FIG. 2 a representative multi-step sliding cam system (SCS), designated generally at 40, for operating one or more first engine valves 42 and one or more second engine valve 44 of a vehicle, such as automobile 10 of FIG. 1. These first and second engine valves 42, 44 are operatively housed within respective first and second heads (e.g., cylinder heads 18A, 18B of FIG. 1) or cylinder banks (e.g., cylinder banks 17A, 17B of FIG. 1) or other operative locations of an internal combustion engine (e.g., ICE assembly 12 of FIG. 1). The first 42 and the second engine valves 44 are illustrated herein as spring-biased poppet valves (although other known types of engine valves may be employed) used to control, for example, the timing and quantity of fuel and air injected into the cylinders as well as, or alternatively, the timing and quantity of exhaust gases expelled from the cylinders. The cam system 40 shown may also be used on a single cylinder without departing from the scope of this disclosure. In the same vein, the SCS architecture 40 of FIG. 2 is applicable to any cam-driven valve technology, including valves used to control flow of other fluids or solids in other technological areas and applications.

To offer variable valve lift (VVL) functionality, which may help to improve engine performance, fuel economy and vehicle emissions, a sliding camshaft assembly 24 is supported by one or more radial bearings 38 and one or more axial bearings 46 such that the camshaft assembly 24 is rotatable about and linearly displaceable along a central axis $A_{C1}$ relative to the engine valves 42, 44, as described in further detail hereinbelow. Rotation of the camshaft assembly 24 variably actuates the engine valves 42, 44 to facilitate, e.g., combustion within the cylinder banks 17A, 17B and production of mechanical energy by the engine 12. Additional bearings 38, 46 may be incorporated into the camshaft assembly 24; optional configurations may employ other known means for slidably and/or rotatably coupling the camshaft assembly 24 to an engine. The camshaft assembly 24 includes a rotating shaft 48, which is rotatable relative to the engine valves 42, 44, but does not otherwise translate horizontally (e.g., left-to-right as viewed in FIG. 2). A first sliding lobe pack 50 is translatable along central axis $A_{C1}$ relative to the first engine valves 42 on the rotating shaft 48. Likewise, a second sliding lobe pack 52 is translatable along central axis $A_{C1}$ relative to the second engine valves 44 on the rotating shaft 48. The first sliding lobe pack 50 and/or second sliding lobe pack 52 may be splined, or otherwise keyed, for common rotation with the fixed shaft 48.

The first sliding lobe pack 50 is configured to operate each first engine valve 42 with a high lift lobe 51, a low lift lobe 53, and a zero lift lobe 55. By comparison, the second sliding lobe pack 52 is configured to operate each second engine valve 14 with a high lift lobe 51 or either of two low lift lobes 53. Other lobe packs with alternative lobe combinations are within the scope of this disclosure. Matching camshaft lobes illustrated in FIG. 2 may be substantially structurally identical to their respective counterparts—e.g., all high lift lobes 51 are identical, all low lift lobes 53 are identical, and all zero lift lobe 55 are identical—to impart substantially identical displacement. In some configurations, when two or more counterpart lobes are located immediately adjacent one another (e.g., the two low lift lobes 53 in the second sliding lobe pack 52), these lobes may be fabricated as a single-piece unitary low lobe structure. Any of the individual lobes described herein and shown in the figures may be referred to numerically, as first, second, third, or the like. As described herein, translation of the first and second sliding lobe packs 50, 52 selectively aligns the high lift lobes 51, low lift lobes 53, and zero lift lobes 55 with the engine valves 42, 44. Alignment of the specific lobes selectively varies the displacement of the first and second engine valves 42, 44. The high lift lobes 51 impart greater motion to the engine valves 42, 44 than the low lift lobes 53. In the same vein, zero lift lobes 55 impart substantially no lift to the first engine valves 42, e.g., such that these engine valves may be selectively deactivated.

Based on the locations of the lobe packs 50, 52 and, thus, the alignment of the high lift, low lift, and zero lift lobes 51, 53, 55 relative to the engine valves 42, 44, the cam system 40 operates at different variable cam stages or steps, including: a high lift stage, a low lift stage, and a cylinder deactivation or active fuel management stage. Each of these operating stages may vary the amount of air and fuel entering the cylinder bores/banks, which varies the operation of the engine. In FIG. 2 there is also shown circumferential or unspooled views 58A' and 58B' of first and second shift barrels 58A and 58B, respectively, that are mounted on the rotating shaft 48. These unspooled views 58A', 58B' illustrate the shift barrel 58A, 58B as if its exterior has been rolled onto a flat plane. Each shift barrel 58A, 58B has a respective pin groove 59A and 59B that extends continuously around the circumference of the shift barrel along an at least partially non-linear path.

Figure 3:
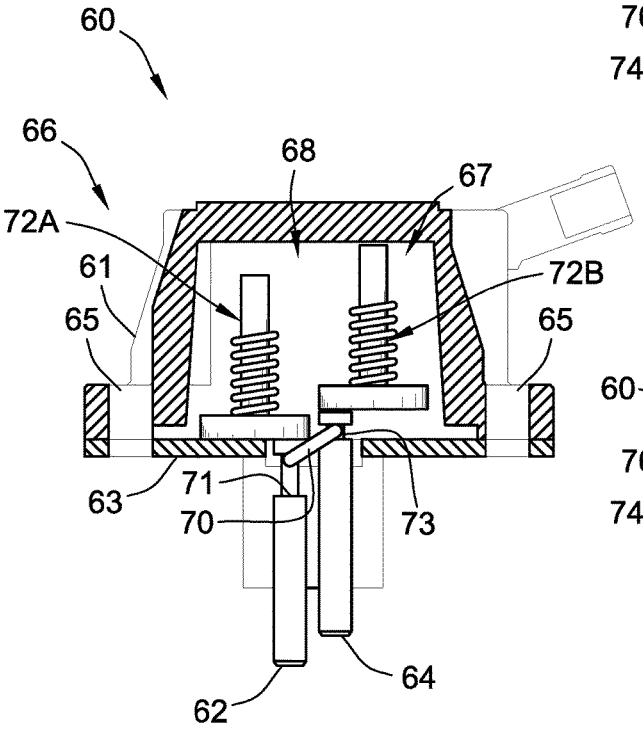
FIG. 3 is a side-view illustration of a representative sliding cam actuator for a multi-step sliding cam system, such as the SCS of FIG. 2, in accordance with aspects of the present disclosure, showing the sliding cam actuator in a first activated state.

To axially displace the camshaft assembly 24, namely the first and second sliding lobe packs 50, 52 of FIG. 2, and change the cam stage of the cam system 40, there is provided a pair of sliding cam actuators 60, each of which is fixedly disposed adjacent a respective shift barrel 58A, 58B. According to the illustrated example, each sliding cam actuator 60 has and, in at least some preferred configurations, is limited to two movable actuator pins: a first actuator pin 62 and a second actuator pin 64, as best seen in FIG. 3. The sliding cam actuator 60 selectively deploys, fires, or otherwise activates the actuator pins 62, 64 such that the pins 62, 64 rotate, translate or otherwise move to then engage one of the grooves 59A, 59B of a corresponding shift barrel 58A, 58B. These shift barrel grooves 59A, 59B are configured to act in opposing directions: firing an actuator pin into the first groove 59A translates both sliding lobe packs 50, 52 in a first direction (e.g., leftward in FIG. 2); conversely, firing one of the actuator pins into the second groove 59B translates both the sliding lobe packs 50, 52 in the opposite direction (e.g., rightward in FIG. 2). Schematically illustrated in FIG. 2 is a cam system controller 36, which may be separate from or embodied in an onboard vehicle central processing unit (CPU). Cam system controller 36 is in communication with, among other things, the two sliding cam actuators 60. This controller 36 is configured to command when and how the sliding cam actuators 60 fire the actuator pins 62, 64. The controller 36 may also monitor the current state of the sliding cam system 40 and, optionally, may help to determine which of the states is currently preferred for operation of the vehicle.

With reference again to FIG. 3, each of the sliding cam actuators 60 of FIG. 2 has an actuator housing, designated generally at 66, from which the first and second actuator pins 62, 64 project. In accordance with aspects of the disclosed concepts, the sliding cam actuators 60 may be substantially structurally identical to one another; for purposes of brevity, both sliding cam actuators 60 shown in FIG. 2 may be described by reference to the sliding cam actuator 60 shown in FIGS. 3 and 4. The representative actuator housing 66 shown in the drawings is a bipartite construction generally composed of a cup-shaped housing shell 61 that is mounted on a generally flat base plate 63, e.g., via fasteners 65, to define an interior compartment 67. Stowed inside the interior compartment 67 of the actuator housing 66 is an electromechanical pin actuator assembly, designated generally as 68 in FIGS. 3 and 4. The base plate 63 is formed with a pin window 69 that is shaped and sized such that proximal (top) ends of both actuator pins 62, 64 extend through the pin window 69 and into the interior compartment 67 to mechanically engage the pin actuator assembly 68. Interposed between the actuator pins 62, 64 is an actuator shank 70 that is rotatably mounted in a cantilevered manner to the base plate 63 such that the actuator shank 70 projects into the pin window 69. It should be appreciated that the actuator housing 66 may comprise greater or fewer parts than that which are shown in the drawings. Optional configurations may eliminate segments of the housing 66 (or the entire housing) and integrate some or all of the components of the sliding cam actuator 60 into a portion of the engine 10.

Figure 3A:
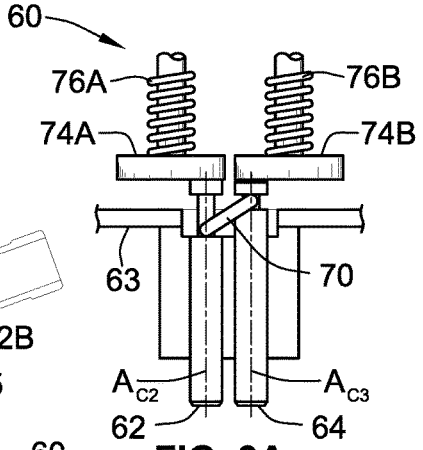
FIGS. 3A and 3B are side-view illustrations of the representative sliding cam actuator of FIG. 3, showing the sliding cam actuator in a deactivated neutral state and a second activated state, respectively.

First and second actuator pins 62, 64 are operable to selectively move from respective first and second retracted positions, as seen in FIG. 3A, to respective first and second extended positions, as seen in FIGS. 3 (for pin 62) and 3B (for pin 64). When deployed to its respective extended position, a distal end of the pin 62, 64 will at least partially seat inside the slot 59A, 59B of the adjacent shift barrel 58A, 58B to thereby cause the sliding camshaft 26 to translate to a new cam location, as described above. Conversely, when an actuator pin 62, 64 is retained in its retracted position, the distal end of the pin 62, 64 disengages from the shift barrel slot 59A, 59B. In the illustrated example, the actuator pins 62, 64 are elongated, generally cylindrical structures that define a columnar geometry with a central longitudinal axis $A_{C2}$ and $A_{C3}$, respectively. At the proximal end of each actuator pin 62, 64 is a respective shank slot 71 and 73 that is toroidal in shape and concentric with the respective central longitudinal axis $A_{C2}$, $A_{C3}$ of that pin. As may be seen in FIG. 3, the first shank slot 71 of the first actuator pin 62 has a first slot length that is greater than the second slot length of second shank slot 73 of the second actuator pin 64.

Figure 4:
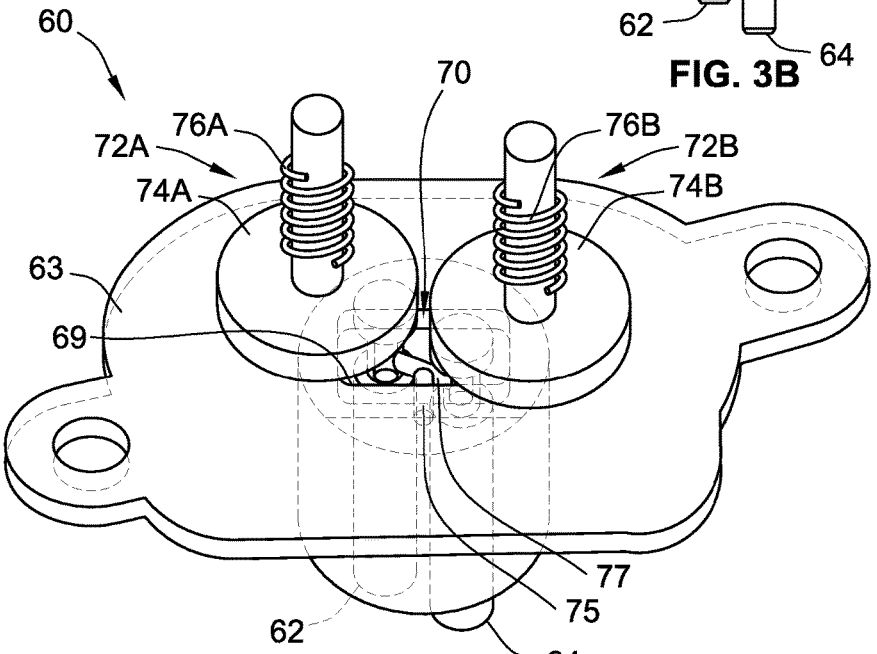
FIG. 4 is a perspective-view illustration of the representative sliding cam actuator of FIG. 3, presented with the housing shell removed to show the actuator "seesaw" shank preventing both actuator pins from being activated simultaneously.

According to the representative architecture illustrated in FIGS. 3 and 4, the pin actuator assembly 68 is comprised of first and second linear actuators 72A and 72B that are stowed inside the actuator housing 66. Each of these linear actuators 72A, 72B engages and selectively moves a respective one of the actuator pins 62 64. While many varieties of linear actuators are known and may be utilized to effectuate the purpose of the pin actuator assembly 68, including hydraulic, pneumatic, and piezoelectric designs, the first and second linear actuators 72A, 72B of FIGS. 3 and 4 are electromechanical devices with reciprocating pistons 74A, 74B that abut proximal (top) ends of the actuator pins 62, 64. Wrapped around a stem of each piston 74A, 74B is a respective electrically activated solenoid coil 76A, 76B. When electrical current is passed through a solenoid coil 76A, 76B in one direction, an electromagnetic field is generated to drive the piston 74A, 74B in a first direction (e.g., downward in FIGS. 3 and 4). Conversely, passing electrical current through a solenoid coil 76A, 76B in the opposite direction will generate an electromagnetic field that drives the piston 74A, 74B in a second, opposite direction (e.g., upward in FIGS. 3 and 4).

Figure 3B:
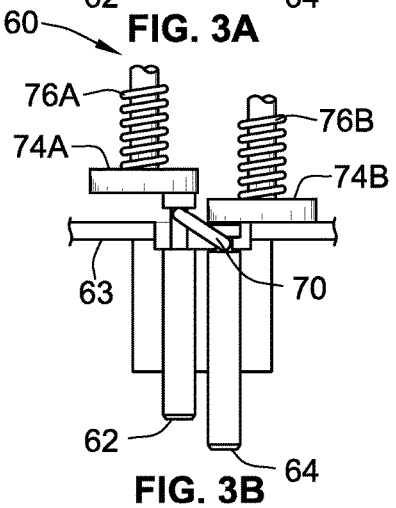

With this configuration, the pin actuator assembly 68 is operable in at least two activated states. By way of non-limiting example, when in a first activated state, as seen in FIG. 3, the pin actuator assembly 68 fires the first solenoid coil 76A of the first piston 74A, causing the first actuator pin 62 to translate rectilinearly to its respective (first) extended position and into engagement with a corresponding shift barrel 58A, 58B to thereby slide the camshaft assembly 24 (first and second sliding lobe packs 50, 52) to a first cam location. When in a second activated state, as seen in FIG. 3B, the pin actuator assembly 68 fires the second solenoid coil 76B of the second piston 74B, causing the second actuator pin 64 to translate rectilinearly to its respective (second) extended position and into engagement with the shift barrel to thereby slide the camshaft assembly 24 to a second cam location. When in a neutral state, as seen in FIG. 3A, neither coil is fired such that neither pin extends into engagement with the shift barrel.

An actuator shank 70 is movably attached, e.g., to the base plate 63 of the actuator housing 66, and engaged with the first and second actuator pins 62, 64. The representative actuator shank 70 illustrated in the drawings is generally composed of an elongated stem 75 that projects generally orthogonally from a crossbar 77. For at least some preferred configurations, the actuator shank 70 is formed as a single-piece, T-shaped structure. The shank's stem 75 pivotably couples the crossbar 77 to the actuator housing 66 such that the crossbar 77 selectively rotates (e.g., counterclockwise) in a first direction, and selectively rotates (e.g., clockwise) in a second direction. Opposing first and second ends the actuator shank 70 crossbar 77 are respectively disposed within the first shank slot 71 of the first actuator pin 62 and the second shank slot 73 of the second actuator pin 62. With this arrangement, moving the first actuator pin 62 to the first extended position (FIG. 3) causes the actuator shank 70 to rotate in the first direction; in so doing, the crossbar 77 of the actuator shank 70 presses against and slides the second actuator pin 64 towards its retracted position. On the other hand, moving the second actuator pin 64 to the second extended position (FIG. 3B) causes the actuator shank 70 to rotate in the second direction; in so doing, the crossbar 77 of the actuator shank 70 presses against and slides the first actuator pin 62 towards the its respective retracted position. The actuator shank 70 thereby prevents both actuator pins 62, 64 from being activated at the same time.

While aspects of the present disclosure have been described in detail with reference to the illustrated embodiments, those skilled in the art will recognize that many modifications may be made thereto without departing from the scope of the present disclosure. The present disclosure is not limited to the precise construction and compositions disclosed herein; any and all modifications, changes, and variations apparent from the foregoing descriptions are within the spirit and scope of the disclosure as defined in the appended claims. Moreover, the present concepts expressly include any and all combinations and subcombinations of the preceding elements and features.

What is claimed:

1. A sliding cam actuator for an internal combustion engine (ICE) assembly, the ICE assembly including multiple engine valves operatively engaged with a sliding camshaft, the sliding camshaft including a shift barrel and multiple cams, the sliding cam actuator comprising:

an actuator housing;

first and second actuator pins projecting from the actuator housing, the first and second actuator pins being configured to selectively move between respective first and second retracted positions and respective first and second extended positions and engage the shift barrel to thereby slide the camshaft, the first actuator pin including a first shank slot having a first slot length, and the second actuator pin including a second shank slot having a second slot length less than the first slot length;

a pin actuator assembly attached to the actuator housing and operable in first and second activated states, wherein the pin actuator assembly, when in the first activated state, moves the first actuator pin to the first extended position into engagement with the shift barrel to thereby slide the camshaft to a first cam location, wherein the pin actuator assembly, when in the second activated state, moves the second actuator pin to the second extended position into engagement with the shift barrel to thereby slide the camshaft to a second cam location; and an actuator shank movably attached to the actuator housing and engaged with the first and second actuator pins, wherein moving the first actuator pin to the first extended position causes the actuator shank to move in a first direction and move the second actuator pin towards the second retracted position, and moving the second actuator pin to the second extended position causes the actuator shank to move in a second direction and move the first actuator pin towards the first retracted position, the actuator shank having opposing first and second ends, the first end of the actuator shank being disposed within the first shank slot of the first actuator pin, and the second end being disposed within the second shank slot of the second actuator pin.

2. The sliding cam actuator of claim 1, wherein the actuator shank includes a stem projecting from a crossbar, the stem pivotably coupling the crossbar to the actuator housing such that the crossbar rotates in the first and second directions.

3. The sliding cam actuator of claim 2, wherein the first actuator pin, when moved to the first extended position, pushes against and rotates the actuator shank in the first direction such that the actuator shank pushes the second actuator pin to the second retracted position, and wherein the second actuator pin, when moved to the second extended position, pushes against and rotates the actuator shank in the second direction such that the actuator shank pushes the first actuator pin to the first retracted position.

4. The sliding cam actuator of claim 1, wherein the first and second actuator pins are each columnar with a respective central longitudinal axis, and wherein each of the first and second shank slots is toroidal and concentric with the respective central longitudinal axis.

5. The sliding cam actuator of claim 1, wherein the pin actuator assembly includes first and second linear actuators stowed inside the actuator housing, the first and second linear actuators each engaging and selectively moving a respective one of the first and second actuator pins.

6. The sliding cam actuator of claim 5, wherein the first linear actuator includes a first piston abutting the first actuator pin, and the second linear actuator includes a second piston abutting the second actuator pin.

7. The sliding cam actuator of claim 6, wherein the first linear actuator includes a first electrically activated solenoid coil configured to drive the first piston, and the second linear actuator includes a second electrically activated solenoid coil configured to drive the second piston.

8. The sliding cam actuator of claim 1, wherein the actuator housing includes a housing shell mounted on a base plate to define an interior compartment.

9. The sliding cam actuator of claim 8, wherein the base plate includes a pin window, and wherein the first and second actuator pins extend through the pin window and into the interior compartment.

10. The sliding cam actuator of claim 9, wherein the pin actuator assembly is stowed inside the interior compartment and the actuator shank is rotatably mounted to the base plate.

11. The sliding cam actuator of claim 1, wherein the actuator shank is a single-piece, T-shaped structure.

12. The sliding cam actuator of claim 1, wherein the actuator shank is interposed between the first and second actuator pins.

13. The sliding cam actuator of claim 1, wherein the actuator shank includes a stem projecting from and integrally formed with a crossbar as a single-piece structure, the stem rotatably mounting the actuator shank to the actuator housing in a cantilevered manner.

14. A motor vehicle, comprising:

a vehicle body defining an engine compartment;

an internal combustion engine (ICE) assembly disposed within the engine compartment, the ICE assembly comprising:

an engine block with a cylinder bank defining a plurality of cylinder bores;

a plurality of pistons each reciprocally movable within a respective one of the cylinder bores;

a plurality of engine valves operable to regulate fluid intake and exhaust of the cylinder bores;

an axially displaceable camshaft rotatably mounted adjacent the engine valves, the camshaft including a shift barrel and a plurality of cam lobes with distinctly shaped profiles configured to operate the engine valves at distinct lifts; and a multi-step sliding cam actuator, including:

first and second slidable actuator pins configured to selectively translate between respective first and second retracted positions and respective first and second extended positions and engage the shift barrel to thereby axially displace the camshaft, the first actuator pin including a first shank slot having a first slot length, and the second actuator pin including a second shank slot having a second slot length less than the first slot length;

a pin actuator assembly operable in: a first activated state, whereat the pin actuator assembly pushes the first actuator pin to the first extended position into engagement with the shift barrel to thereby slide the camshaft to a first cam location; and a second activated state, whereat the pin actuator assembly pushes the second actuator pin to the second extended position into engagement with the shift barrel to thereby slide the camshaft to a second cam location; and an actuator shank interposed between and engaged with the first and second actuator pins, wherein sliding the first actuator pin to the first extended position causes the actuator shank to rotate in a first direction and push the second actuator pin towards the second retracted position, and sliding the second actuator pin to the second extended position causes the actuator shank to rotate in a second direction, opposite the first direction, and push the first actuator pin towards the first retracted position, the actuator shank having opposing first and second ends, the first end of the actuator shank being disposed within the first shank slot of the first actuator pin, and the second end being disposed within the second shank slot of the second actuator pin.

15. A method of assembling a sliding cam actuator for an internal combustion engine (ICE) assembly, the ICE assembly including multiple engine valves operatively engaged with a sliding camshaft, the sliding camshaft including a shift barrel and multiple cams, the method comprising:

attaching first and second actuator pins to an actuator housing such that the first and second actuator pins are selectively movable between respective first and second retracted positions and respective first and second extended positions to engage with the shift barrel and thereby slide the camshaft, the first actuator pin including a first shank slot having a first slot length, and the second actuator pin including a second shank slot having a second slot length less than the first slot length;

attaching a pin actuator assembly to the actuator housing, the pin actuator assembly being operable in a first activated state, whereat the pin actuator assembly moves the first actuator pin to the first extended position into engagement with the shift barrel to thereby slide the camshaft to a first cam location, and a second activated state, whereat the pin actuator assembly moves the second actuator pin to a second extended position into engagement with the shift barrel to thereby slide the camshaft to a second cam location; and movably attaching an actuator shank to the actuator housing and engaging the actuator shank with the actuator pins such that moving the first actuator pin to the first extended position causes the actuator shank to move in a first direction and move the second actuator pin towards the second retracted position, and moving the second actuator pin to the second extended position causes the actuator shank to move in a second direction and move the first actuator pin towards the first retracted position, the actuator shank having opposing first and second ends, the first end of the actuator shank being disposed within the first shank slot of the first actuator pin, and the second end being disposed within the second shank slot of the second actuator pin.

16. The method of claim 15, wherein the first and second actuator pins are each columnar with a respective central longitudinal axis, and wherein each of the first and second shank slots is toroidal and concentric with the respective central longitudinal axis.

17. The method of claim 15, wherein the pin actuator assembly includes first and second linear actuators stowed inside the actuator housing, the first and second linear actuators each engaging and selectively moving a respective one of the first and second actuator pins.

18. The method of claim 15, wherein the actuator housing includes a housing shell mounted on a base plate to define an interior compartment within which is housed the pin actuator assembly, wherein the base plate includes a pin window, and wherein the first and second actuator pins extend through the pin window and into the interior compartment.

19. The method of claim 15, wherein the actuator shank is interposed between the first and second actuator pins.

20. The method of claim 15, wherein the actuator shank includes a stem projecting from and integrally formed with a crossbar as a single-piece structure, the stem rotatably mounting the actuator shank to the actuator housing in a cantilevered manner.

* * * * *